US005644679A

United States Patent [19]

Scott et al.

[11] Patent Number: 5,644,679

[45] Date of Patent: Jul. 1, 1997

[54] METHOD AND DEVICE FOR PREPROCESSING AN ACOUSTIC SIGNAL UPSTREAM OF A SPEECH CODER

[75] Inventors: Sophie Scott, Paris; William Navarro, Velizy Villacoublay, both of France

[73] Assignee: Matra Communication, Quimper, France

[21] Appl. No.: 462,209

[22] Filed: Jun. 5, 1995

[30] Foreign Application Priority Data

Jun. 3, 1994 [FR] France ..... 94 06824

[51] Int. Cl.[6] ..... G10L 9/00

[52] U.S. Cl. ..... 395/2.33; 395/2.1; 395/2.3; 395/2.29; 395/2.23

[58] Field of Search ..... 395/2.33, 2.34, 395/2.35, 2.28, 2.29, 2.7, 2.32

[56] References Cited

FOREIGN PATENT DOCUMENTS 0347307 12/1989 European Pat. Off. .
0477960 4/1992 European Pat. Off. .

*Primary Examiner*—Allen R. MacDonald
*Assistant Examiner*—Vijay B. Chawan
*Attorney, Agent, or Firm*—Larson and Taylor

[57] ABSTRACT

The input acoustic signal is subjected to high-pass filtering. The energy of the high-pass filtered signal is compared with that of the unfiltered signal in order to determine a state of the signal from among a first state for which the energy of the high-pass filtered signal is above a predetermined fraction of the energy of the unfiltered signal and a second state for which the energy of the high-pass filtered signal is below the predetermined fraction of the energy of the unfiltered signal. The high-pass filtered signal subjected to pre-emphasis of the high frequencies is addressed to the input of the coder when the signal is in its second state.

8 Claims, 3 Drawing Sheets

METHOD AND DEVICE FOR PREPROCESSING AN ACOUSTIC SIGNAL UPSTREAM OF A SPEECH CODER

BACKGROUND OF THE INVENTION

The present invention relates to a method and a device for preprocessing the acoustic signal delivered to a speech coder. It applies especially, but not exclusively, to improving the performance of low bit rate speech coders.

The present-day speech coders with low bit rate (typically 5 kbit/s for a sampling frequency of 8 kHz) yield their best performance on signals exhibiting a "telephone" spectrum, that is to say one in the 300–3400 Hz band and with pre-emphasis in the high frequencies. These spectral characteristics correspond to the IRS (Intermediate Reference System) template defined by the CCITT in Recommendation P48. This template has been defined for telephone handsets, both for input (microphone) and output (ear pieces).

However, it happens more and more frequently that the input signal of a speech coder exhibits a "flatter" spectrum, for example when a hands-free installation is used, employing a microphone with linear frequency response. Conventional vocoders are designed to be independent of the input with which they operate, and, besides, they are not informed of the characteristics of this input. If microphones with different characteristics are likely to be connected up to the vocoder, or more generally if the vocoder is likely to receive acoustic signals exhibiting different spectral characteristics, there are cases in which the vocoder is used in a sub-optimal manner.

In this context, a main purpose of the present invention is to improve a vocoder's performance by rendering it less dependent on the spectral characteristics of the input signal.

SUMMARY OF THE INVENTION

The method according to the invention consists in subjecting the input acoustic signal to high-pass filtering, in comparing the energy of the high-pass filtered signal with that of the unfiltered signal in order to determine a state of the signal from among a first state for which the energy of the high-pass filtered signal is above a predetermined fraction of the energy of the unfiltered signal, and a second state for which the energy of the high pass filtered signal is below the predetermined fraction of the energy of the unfiltered signal, and in addressing to the input of the coder the high-pass filtered signal subjected to pre-emphasis of the high frequencies when the signal is in its second state.

The high-pass filter used is typically a filter with abrupt cut-off at 400 Hz, and the predetermined energy fraction is typically from 85 to 95%. The first state of the signal corresponds to the IRS characteristics, and the second state corresponds to a flatter spectrum of the input acoustic signal containing proportionally more energy at the low frequencies. With the method according to the invention, such a signal with flat spectrum is preprocessed (high-pass filtering and pre-emphasis) to render its spectral characteristics closer to those of the IRS template. The use of high-pass filtering to determine the state of the signal has the advantage, as compared with low-pass filtering, of enabling the filtered signal to be used to address it (after pre-emphasis) to the input of the vocoder.

Preferably, the determined state of the signal can be modified only when the input acoustic signal, or the high-pass filtered signal, has energy above a predetermined threshold. Indeed, in the contrary case (for example in a region of silence or of weak ambient noise), the energy of the signal is too weak for it to be possible reliably to evaluate its spectral characteristics.

When the acoustic signal is digitized as successive frames, there is detection of whether the signal included in each frame is in a first condition corresponding to the first state or in a second condition corresponding to the second state, and the state of the signal is determined on the basis of the frame-by-frame conditions, modifying the determined state only after several successive frames show a signal condition different from that corresponding to the previously determined state. This introduces a kind of hysteresis which makes it possible to take into account the fast variations of the spectral envelope of the speech signal, due to ambient noise or to the speech itself (the timbre of the voice is not constant). The risks of false determination of the state of the signal are thus reduced, thereby leading to better quality of the coded signal and avoiding the introduction of discontinuities of timbre which could be due to spurious modifications of the determined state.

The preprocessing device according to the invention comprises a high-pass filter receiving the input acoustic signal, means for calculating the energies contained respectively in the acoustic signal and in the output signal of the high-pass filter, means for comparing the calculated energies, and a filter for pre-emphasis of the high frequencies, the input of which receives the output signal from the high-pass filter, and the output of which delivers the signal addressed to the input of the coder when the means of comparison reveal that the output signal from the high-pass filter contains less than a predetermined fraction of the energy of the acoustic signal.

DESCRIPTION OF A PREFERRED EMBODIMENT

Figure 1:
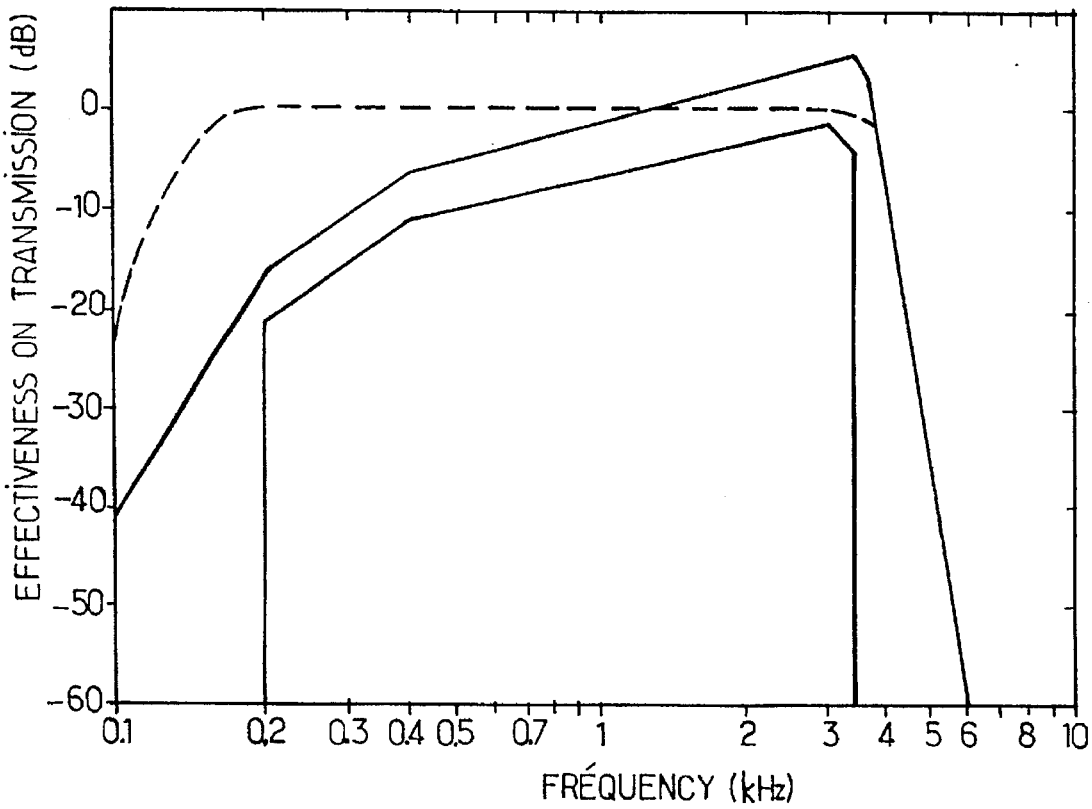
FIG. 1 is a chart illustrating the characteristics of an acoustic signal of IRS type and of a signal of linear type.

In FIG. 1, the two solid lines correspond to the bounding of the IRS template defined for microphones in Recommendation P48 of the CCITT. It is seen that an IRS type microphone signal exhibits strong attenuation in the lower part of the spectrum (between 0 and 300 Hz) and a relative emphasis in the high frequencies. By comparison, a signal of linear type, delivered for example by the microphone of a hands-free installation, exhibits a flatter spectrum, in particular not having the strong attenuation at low frequencies (a typical example of such a signal of linear type is illustrated by a dashed line in the chart of FIG. 1).

Figure 2:
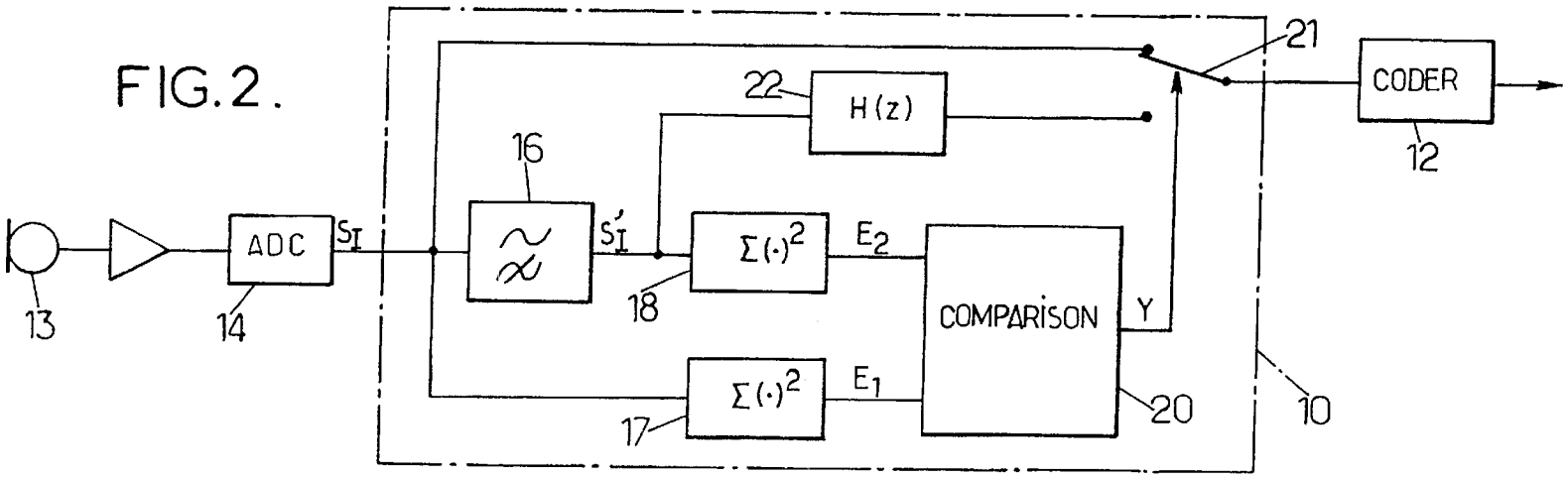
FIG. 2 is a schematic diagram of a preprocessing device according to the invention.

The preprocessing device 10 according to the invention, shown diagrammatically in FIG. 2, takes advantage of these spectral properties. This device processes the input signal delivered by an acoustic signal source in order to address it to a speech coder 12. The coder 12 is a low bit rate coder optimized for an input signal of IRS type. It may be, among other things, a linear predictive coder with excitation by regular pulse vectors (RP CELP), such as described in the document EP A-0 347 307. The coder 12 has no a priori knowledge of the source of the acoustic signal which is addressed to it.

In the diagram of FIG. 2, the input acoustic signal $S_I$ is the output signal from a microphone 13 which has been amplified and digitized by an analog/digital converter 14. The signal is typically digitized at a sampling rate of 8 kHz, and is put into the form of successive frames of 30 ms each containing 240 16-bit samples.

The preprocessing device 10 comprises a high-pass filter 16 receiving the input acoustic signal $S_I$ and delivering the filtered signal $S_I'$. The filter 16 is typically a digital filter of bi-quad type having an abrupt cut-off at 400 Hz. The energies E1 and E2 contained in each frame of the input acoustic signal $S_I$ and of the filtered signal $S_I'$ are calculated by two units 17, 18 each forming the sum of the squares of the samples of each frame which it receives. The calculated energies E1 and E2 are delivered to a comparison unit 20 which determines the state of the signal in the form of a bit Y which equals zero when it is determined that the signal is of IRS type (state $Y_A$), and one when it is determined that the signal is rather of linear type (state $Y_B$).

The output of the preprocessing device 10 which is connected to the input of the coder 12 consists of a terminal of a switch 21 whose other terminal is connected either to the input of the high-pass filter 16 or to the output of a pre-emphasis filter 22, depending on the value of the bit Y delivered by the comparison unit 20. When Y=0 (state $Y_A$), the switch 21 is in the position represented in FIG. 2, and the input acoustic signal $S_I$ is addressed to the input of the coder 12. In the other position (Y=1, state $Y_B$), it is the output of the pre-emphasis filter 22 which is addressed to the input of the coder 12. The pre-emphasis filter 22 receives the high-pass filtered signal $S_I'$ and applies thereto a transfer function of the form $H(z)=1-\beta/z$ in which $\beta$ denotes a pre-emphasis coefficient which is typically of the order of 0.4. Thus, when the acoustic signal is of linear type, it is transformed by high-pass filtering (filter 16) and pre-emphasis (filter 22) so as to be addressed to the input of the coder 12 with spectral characteristics closer to those of the IRS template.

Given that the high-pass filter 16 hardly affects the input signal when the latter has IRS characteristics, it is also possible to provide the coder 12 with the high-pass filtered signal $S_I'$ when it has been determined that the signal is in the state $Y_A$ corresponding to the IRS characteristics. A variant of the diagram of FIG. 2 then consists in dispensing with the switch 21 by connecting the output of the pre-emphasis filter 22 directly to the input of the coder 12, and in controlling the value of the coefficient $\beta$ in the filter 22 as a function of the value of the state bit Y (for example $\beta=0$ when Y=0 and $\beta=0.4$ when Y=1).

Figure 3:
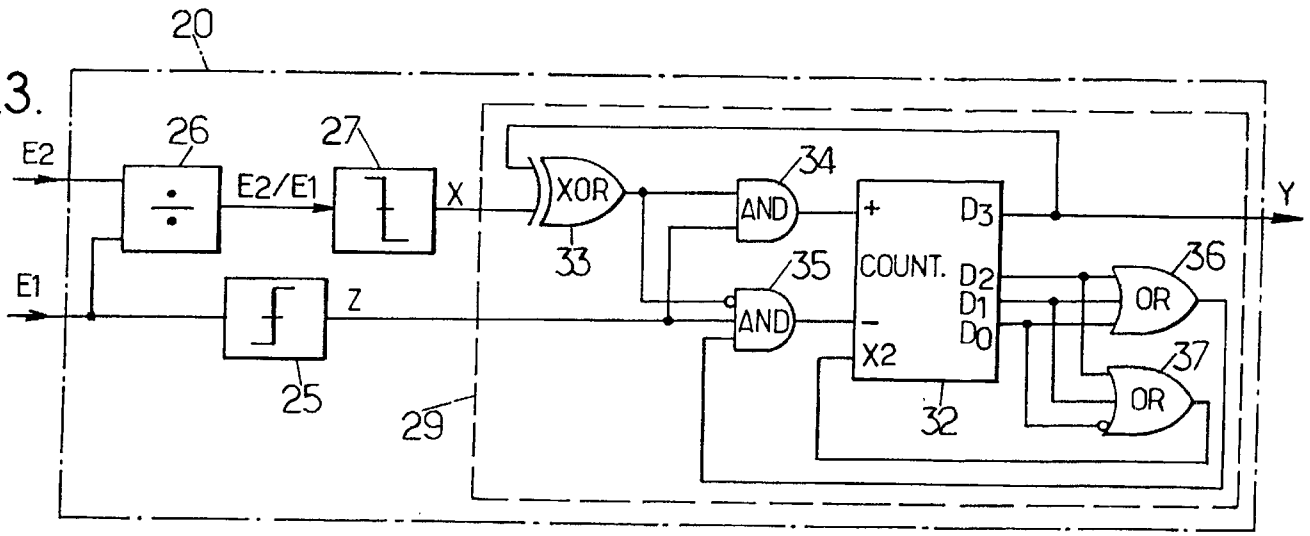
FIG. 3 is a more detailed diagram of the means of comparison of the device of FIG. 2.

The comparison unit 20 is for example in accordance with the diagram illustrated in FIG. 3. The energy E1 of each frame of the input signal $S_I$ is addressed to the input of a threshold comparator 25 which delivers a bit Z of value 0 when the energy E1 is below a predetermined energy threshold, and of value 1 when the energy E1 is above the threshold. The energy threshold is typically of the order of −38 dB with respect to the saturation energy of the signal. The comparator 25 serves to inhibit the determination of the state of the signal when the latter contains two little energy to be representative of the characteristics of the source. In this case, the determined state of the signal remains unchanged.

The energies E1 and E2 are addressed to the digital divider 26 which calculates the ratio E2/E1 for each frame. This ratio E2/E1 is addressed to another threshold comparator 27 which delivers a bit X of value 0 when the ratio E2/E1 is above a predetermined threshold, and of value 1 when the ratio E2/E1 is below the threshold. This threshold on the ratio E2/E1 is typically of the order of 0.3. The bit X is representative of a condition of the signal in each frame. The condition X=0 corresponds to the IRS characteristics of the input signal (state $Y_A$), and the condition X=1 corresponds to the linear characteristic (state $Y_B$). To avoid repeated and spurious changes of state in the event of short-term variations in the voice excitation, the state bit Y is not taken directly equal to the condition bit X but results from a processing of the successive condition bits X by a state determination circuit 29.

Figure 4:
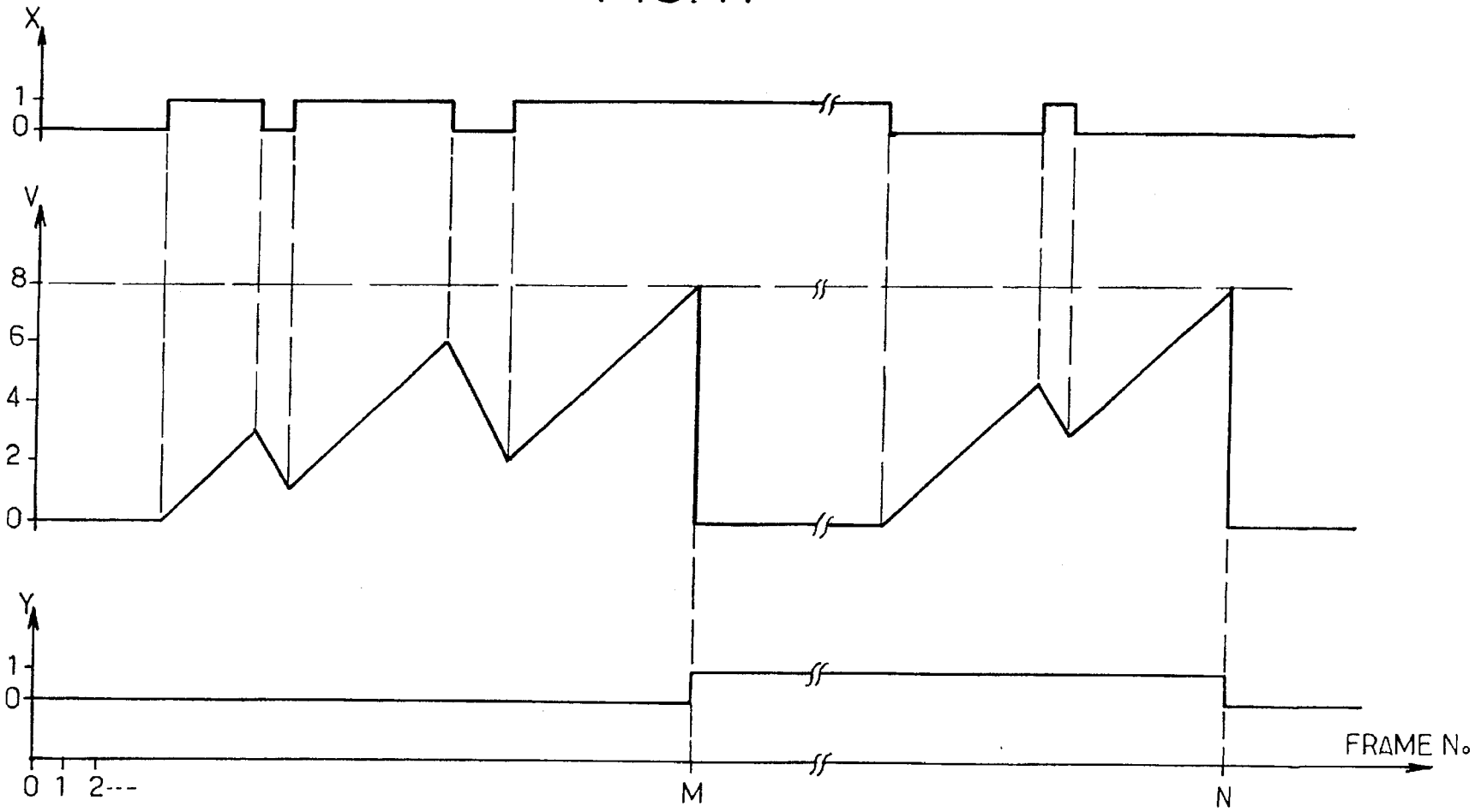
FIG. 4 shows timing diagrams illustrating the way of determining the state of the signal via the means of FIG. 3.

The operation of the state determination circuit 29 is illustrated in FIG. 4 where The upper timing diagram illustrates an example of the evolution of the bit X provided by the comparator 27. The state bit Y (lower timing diagram) is initialized to 0, since The IRS characteristics are encountered most frequently. A counting variable V, initially set to 0, is calculated frame after frame. The variable V is incremented by one unit each time that the condition X of the signal in a frame differs from that corresponding to the determined state (X=1 and Y=0, or X=0 and Y=1). In the contrary case (X=Y=0 or 1) the variable V is decremented by two units if it is different from 0 and from 1, decremented by one unit if it is equal to 1, and held unchanged if it is equal to 0. Once the variable V reaches a predetermined threshold (8 in the example considered), it is reset to 0 and the value of the bit Y is changed, so that the signal is determined to have changed state. Thus, in the example represented in FIG. 1, the signal is in the state $Y_A$ up to frame M, in the state $Y_B$ between frames M and N (change of signal source), then again in the state $Y_A$ onwards of frame N. Of course, other ways of incrementing and decrementing and other threshold values would be usable.

The above counting mode can for example be obtained by the circuit 29 represented in FIG. 3. This circuit comprises a counter 32 on four bits, of which the most significant bit corresponds to the state bit Y, and the three least significant bits represent the counting variable V. The bits X and Y are delivered to the input of an EXCLUSIVE OR gate 33 whose output is addressed to incrementation input of the counter 32 via an AND gate 34 whose other input receives bit Z provided by the threshold comparator 25. Thus, the variable V is incremented when X≠Y and Z=1. The inverted output from the gate 33 is delivered to a decrementation input of the counter 32 via another AND gate 35 whose other two inputs respectively receive the bit Z provided by the comparator 25, and the output from an OR gate 36 with three inputs receiving the three least significant bits of the counter 32. The counter 32 is configured to double the pulses received on its decrementation input when its least significant bit equals 0 or when at least one of the two following bits equals 1, as shown diagrammatically by the OR gate 37 in FIG. 3. Thus, the counter 32 is decremented (by one unit if V=1 and by two units if V>1) when X=Y and Z=1 and V≠0. When the energy of the input signal is insufficient, we have Z=0 and the determination circuit 29 is not activated since the AND gates 34, 35 prevent modification of the value of the counter 32.

We claim:

1. Method of preprocessing an acoustic signal upstream of a speech coder, comprising the steps of:

high-pass filtering said acoustic signal;

comparing the energy of the high-pass filtered signal with the energy of the unfiltered acoustic signal in order to determine a signal state from among a first state for which the energy of the high-pass filtered signal is above a predetermined fraction of the energy of the unfiltered acoustic signal and a second state for which the energy of the high-pass filtered signal is below the predetermined fraction of the energy of the unfiltered signal; and when said second state is determined, addressing the high-pass filtered signal with pre-emphasized high frequencies to the input of the coder.

2. Method according to claim 1, wherein the determined signal state is not modified when said acoustic signal or the high-pass filtered signal has energy below a predetermined threshold.

3. Method according to claim 1, wherein, the acoustic signal being digitized as successive frames, the determination of the signal state comprises the steps of:

detecting frame-by-frame whether the acoustic signal is in a first condition, corresponding to the first state, for which the calculated energy of the frame of the high-pass filtered signal is above the predetermined fraction of the calculated energy of the frame of the unfiltered acoustic signal, or in a second condition, corresponding to the second state, for which the calculated energy of the frame of the high-pass filtered signal is below the predetermined fraction of the calculated energy of the frame of the unfiltered acoustic signal; and determining the signal state on the basis of the frame-by-frame conditions, by modifying the determined signal state only after several successive frames show a signal condition different from that corresponding to the previously determined state.

4. Method according to claim 3, comprising the steps of:

incrementing a counting variable when the condition of the signal in a frame differs from that corresponding to the determined signal state;

decrementing said counting variable when the condition of the signal in a frame is that corresponding to the determined signal state unless said counting variable equals zero; and when the counting variable reaches a predetermined threshold, resetting to zero said counting variable, and determining that the signal state has changed.

5. Device for preprocessing an acoustic signal upstream of a speech coder, comprising a high-pass filter receiving said acoustic signal; means for calculating the energies contained respectively in said acoustic signal and in the output signal of the high-pass filter; means for comparing said calculated energies; and a filter for pre-emphasis of the high frequencies, wherein the input of the pre-emphasis filter receives the output signal of the high-pass filter, and the output of the pre-emphasis filter delivers a signal addressed to the input of the speech coder when the means for comparing reveal that the output signal of the high-pass filter contains less than a predetermined fraction of the energy of said acoustic signal.

6. Device according to claim 5, wherein the acoustic signal is digitized as successive frames, wherein said energies are calculated for each frame by the means for calculating, and the means for comparing comprise a comparator which detects frame by frame whether the acoustic signal is in a first or a second condition according to whether the ratio between the calculated energy of the output signal of the high-pass filter and the calculated energy of said acoustic signal is above or, respectively, below a predetermined value, and means for determining a signal state from among first and second states corresponding respectively to the first and second conditions of the acoustic signal per frame, wherein said means for determining the signal state modify the determined signal state only after the comparator indicates for several successive frames a signal condition different from that corresponding to the previously determined signal state, and wherein the pre-emphasis filter is used to filter the signal addressed to the input of the speech coder only when said second state is determined.

7. Device according to claim 6, wherein the means for determining the signal state comprise a counter calculating after each frame a counting variable, the counter incrementing said counting variable when the comparator indicates a signal condition different from that corresponding to the determined signal state, the counter decrementing said counting variable, unless said counting variable equals zero, when the comparator indicates a signal condition identical to that corresponding to the determined signal state, and the counter resetting said counting variable to zero when said counting variable reaches a predetermined threshold, the determined signal state being modified on each reset to zero of the counting variable.

8. Device according to claim 6, further comprising another comparator which compares the calculated energy of said acoustic signal or of the high-pass filtered signal with another predetermined threshold, so as to activate the means for determining the signal state only when said other threshold is exceeded.

* * * * *